US005095576A

United States Patent [19]

Galigan

[11] Patent Number: 5,095,576

[45] Date of Patent: Mar. 17, 1992

[54] HOSE COVER

[76] Inventor: May Galigan, 5219 - 126 Street, Edmonton, Alberta, Canada, T6H 3W5

[21] Appl. No.: 619,416

[22] Filed: Nov. 29, 1990

[51] Int. Cl.[5] ..... A47L 9/24

[52] U.S. Cl. ..... 15/257 A; 15/325

[58] Field of Search ..... 15/257 A, 325, 410

[56] References Cited

U.S. PATENT DOCUMENTS 4,831,682 5/1989 White ..... 15/325

FOREIGN PATENT DOCUMENTS 223710 8/1987 European Pat. Off. ..... 15/377

*Primary Examiner*—Chris K. Moore

*Attorney, Agent, or Firm*—Beveridge, DeGrandi & Weilacher

[57] ABSTRACT

A device for protecting furniture and interior finishing from the abrasive damage which may be caused by a vacuum hose. The device is a removable fabric sleeve used to cover the vacuum hose. This provides the vacuum hose with an intermediate non-abrasive sliding contact surface.

2 Claims, 1 Drawing Sheet

HOSE COVER

The present invention relates to a Method and Apparatus of protecting furniture and interior finishing from damage caused by a vacuum hose.

BACKGROUND OF THE INVENTION

Vacuum cleaners hoses are constructed with a plurality of corrugations which enhance flexibility. This flexibility is required to bend around corners and pieces of furniture. Unfortunately, the corrugations have been known to cause damage when pulled across furniture and interior finishing. The problem is presently being addressed by placing edge protectors on exposed edges of furniture or interior finishing along the path of the vacuum cleaner. These edge protectors are effective, however, there are too many exposed edges to protect them all with edge protectors and an extensive use of edge protectors is not aesthetically pleasing.

SUMMARY OF THE INVENTION

What is required is an alternate method of protecting furniture and interior finishing from damage caused by a vacuum hose.

According to one aspect of the present invention there is provided a Method of protecting furniture and interior finishing from damage caused by a vacuum hose. This method is comprised of the step of covering the vacuum hose with a removable fabric sleeve, thereby providing the vacuum hose with an intermediate non-abrasive sliding contact surface.

The fabric sleeve is in contact with furniture and interior finishings rather than the corrugated vacuum hose. This permits the vacuum hose to slide over the exposed edges of furniture and interior finishings, such as wall paper, without causing damage. Over prolonged use the sleeve will become soiled and must be replaced. For this reason the sleeve must be removable, as use of a soiled sleeve would soil the fabric of furniture. The Applicant prefers to construct the sleeve from a fabric which is a washable plush material. The plush material provides an extra cushion to eliminate any possibility of the vacuum hose causing damage. The ability to wash the material allows the sleeve to be reused.

According to another aspect of the invention there is provided an Apparatus for protecting furniture and interior finishing from damage caused by a vacuum hose. The Apparatus is comprised of a fabric sleeve having opposed ends with means for clamping the fabric sleeve to a vacuum hose disposed at each end of the sleeve.

The Applicant has had success with a simple form of Clamping means. The sleeve has an interior surface and an exterior surface. The clamping means is a longitudinal cut in the sleeve adjacent each of the ends which creates a first portion and a second portion. A first fastening means is disposed on the interior surface of the first portion. A second fastening means is disposed on the exterior surface of the second portion. By laying the first portion over the second portion and mating the first fastening means with the second fastening means a clamping force is exerted to secure the sleeve to the vacuum hose.

BRIEF DESCRIPTION OF THE DRAWINGS

These and other features of the invention will become more apparent from the following description in which reference is made to the appended drawings wherein.

DETAILED DESCRIPTION OF THE PREFERRED EMBODIMENT

Figure 1:
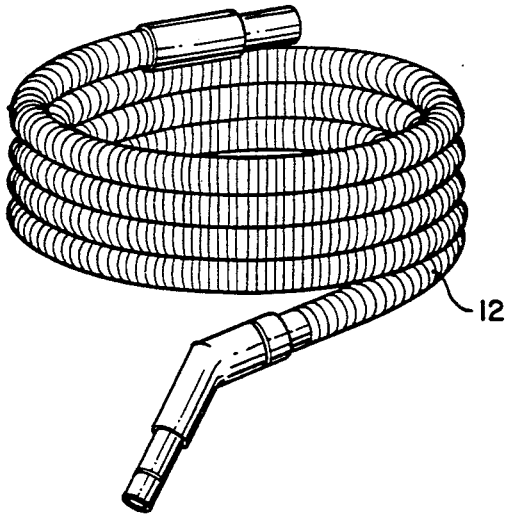
Fig. 1 (PRIOR ART)
FIG. 1 which is labelled as PRIOR ART, is a perspective view of a form of vacuum hose presently in use.
Figure 2:
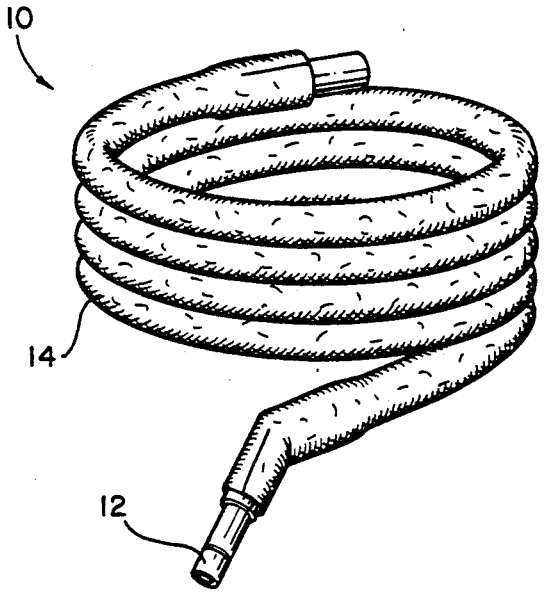
FIG. 2 is a perspective view of a vacuum hose which has been equipped with a preferred embodiment of the invention.
Figure 3:
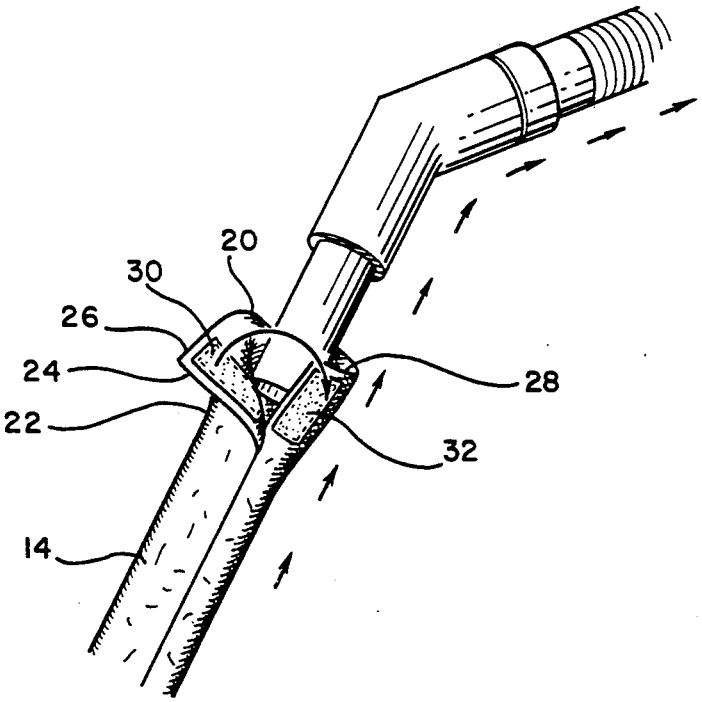
FIG. 3 is a detailed perspective view of a portion of the Apparatus illustrated in FIG. 2.

The preferred embodiment, generally identified by reference numeral 10, is an Apparatus for protecting furniture and interior finishing from damage caused by a vacuum hose. For the purpose of the description the vacuum hose which is considered part of the PRIOR ART has been identified by reference numeral 12 and is illustrated in FIG. 1. Apparatus 10 is illustrated in FIGS. 2 and 3. The Method associated with Apparatus 10 will be described in relation to the use and operation of the Apparatus.

Apparatus 10 consists of a fabric sleeve 14 having opposed ends 16 and 18. Means is provided at each end of sleeve 14 for clamping sleeve 14 to vacuum hose 12. For the purpose of the description of the clamping means sleeve 14 can be considered to have an interior surface 20 and an exterior surface 22. Referring to FIG. 3, the clamping means consists of a longitudinal cut 24 in sleeve 14 adjacent each of ends 16 and 18 which longitudinally divides ends 16 and 18 into a first portion 26 and a second portion 28. Fastening means are used to connect first portion 26 and second portion 28 together. The fastening means the Applicant prefers are mating tape fasteners. A first tape fastener 30 is disposed on interior surface 20 of first portion 26. A second tape fastener 32 is disposed on exterior surface 22 of second portion 28. By laying first portion 26 over second portion 28 and mating first tape fastener 30 with second tape fastener 32 a clamping force is exerted to secure sleeve 14 to vacuum hose 12. The Applicant has found that the holding power of the tape fasteners is enhanced if an elastic (not shown) is placed at the each of ends 16 and 18, such that a stretching of the elastic occurs to increase the clamping force upon vacuum hose 12 when first tape fastener 30 is mated with second tape fastener 32.

The use and operation of Apparatus 10 will now be described in relataion to the preferred Method and with reference to FIGS. 1 through 3. Referring to FIG. 1, an existing vacuum hose 12 is used. Sleeve 14 is slid over vacuum hose 12, as illustrated in FIG. 3. Once sleeve 14 is slid into place, first portion 26 is laid over second portion 28 and mating first tape fastener 30 with second tape fastener 32 to exert a clamping force which secures each of ends 16 and 18 of sleeve 14 to vacumm hose 12. The Method consists of the step of covering vacuum hose 12 with a removable fabric sleeve 14, as is illustrated in FIG. 2. Sleeve 14 provides vacuum hose 12 with an intermediate non-abrasive sliding contact surface, which protects furniture and interior finishing from damage caused by vacuum hose 14. The Applicant prefers to construct the sleeve from a fabric which is a washable plush material. A fabric sold under the trade mark "fun fur", has been found to be particularly suited for the purpose intended. The plush material provides an extra cushion to eliminate any possibility of the vacuum hose causing damage. The ability to wash the material allows the sleeve to be reused. Fun fur has been found to have other desirable properties. Animal hair clings to the fun fur, and can readily be removed by running ones hand along sleeve 14. Moisture is not readily absorbed. If sleeve 14 is dragged through water, the water can be quickly removed by dabbing the moist spots with a paper towel.

The described invention has proven to provide particular benefits when vacuum hose 12 is equipped with an electric power head (not shown). Electric power heads are commonly used with built in vacuum hoses. A cord is run along side the vacuum hose to provide electrical power to the rotating sweeping mechanism in the power head. The cord is secured to the vacuum hose with a plurality of spaced clips. The clips which secure the cord aggravate the extent do which vacuum hose 12 catches on furniture and interior finishings. In addition, the cord turns and twists as it is dragged and the cord and vacuum hose tend to become tangled. The use of apparatus 10 has been found to eliminate both the catching and tangling problems otherwise inherent in a vacuum hose used with a power head.

It will be apparent to one skilled in the art that modifications may be made to the illustrated embodiment without departing from the spirit and scope of the invention as defined by the claims. In particular, there are numerous alternate methods of attaching sleeve 14 to vacuum hose 12.

The embodiments of the invention in which an exclusive property or privilege is claimed are defined as follows:

1. An apparatus for protecting furniture and interior furnishings from damage due to abrasion caused by a vacuum hose sliding across stationary surfaces on the furniture and interior furnishings, comprising:

a. a continuous tubular fabric sleeve having, the entire surface thereof having a uniformly non-abrasive texture, said sleeve opposed ends wherein a vacuum hose may be inserted from one of the ends until substantially all of the vacuum hose is covered by the sleeve;

b. means for clamping the fabric sleeve to said vacuum hose disposed at each end of the sleeve, such that when the fabric sleeve is immovably secured to said vacuum hose it serves as an intermediate non-abrasive contact surface between the vacuum hose and the furniture and interior furnishings.

2. An Apparatus as defined in claim 1 the sleeve having an interior surface and an exterior surface, the clamping means being a longitudinal cut in the sleeve adjacent each of the ends creating a first portion and a second portion, a first fastening means being disposed on the interior surface of the first portion, a second fastening means being disposed on the exterior surface of the second portion, such that by laying the first portion over the second portion and mating the first fastening means with the second fastening means a clamping force is exerted to secure the sleeve to the vacuum hose.

* * * * *